US010233945B2

(12) United States Patent
Yoshida et al.

(10) Patent No.: US 10,233,945 B2
(45) Date of Patent: Mar. 19, 2019

(54) COMPRESSOR ASSEMBLY METHOD, AND BUNDLE GUIDING DEVICE

(71) Applicant: MITSUBISHI HEAVY INDUSTRIES COMPRESSOR CORPORATION, Tokyo (JP)

(72) Inventors: Satoru Yoshida, Hiroshima (JP); Toru Yoshimune, Hiroshima (JP)

(73) Assignee: Mitsubishi Heavy Industries Compressor Corporation, Tokyo (JP)

( * ) Notice: Subject to any disclaimer, the term of this patent is extended or adjusted under 35 U.S.C. 154(b) by 847 days.

(21) Appl. No.: 14/759,856

(22) PCT Filed: Oct. 2, 2013

(86) PCT No.: PCT/JP2013/076833
§ 371 (c)(1),
(2) Date: Jul. 8, 2015

(87) PCT Pub. No.: WO2014/132477
PCT Pub. Date: Sep. 4, 2014

(65) Prior Publication Data

US 2015/0354594 A1 Dec. 10, 2015

(30) Foreign Application Priority Data

Feb. 27, 2013 (JP) ..... 2013-037317

(51) Int. Cl.
*F04D 29/26* (2006.01)
*F04D 29/40* (2006.01)
(Continued)

(52) U.S. Cl.
CPC ..... *F04D 29/603* (2013.01); *F04D 17/10* (2013.01); *F04D 17/122* (2013.01); *F04D 19/00* (2013.01);
(Continued)

(58) Field of Classification Search
CPC ..... F04D 29/403; F04D 29/603; F04D 29/26; F04D 29/624; F04D 29/644; F04D 17/10; F04D 17/122; Y10T 29/49247
See application file for complete search history.

(56) References Cited

U.S. PATENT DOCUMENTS 3,937,369 A 2/1976 Seals
3,937,589 A 2/1976 Remberg
(Continued)

FOREIGN PATENT DOCUMENTS

CN 86102901 A 11/1986
CN 102720705 A 10/2012
(Continued)

OTHER PUBLICATIONS

Chinese Office Action and Search Report dated May 31, 2016, for Chinese Application No. 201380069679.3 with the English translation.

(Continued)

*Primary Examiner* — Bayan Salone
(74) *Attorney, Agent, or Firm* — Birch, Stewart, Kolasch & Birch, LLP

(57) ABSTRACT

This compressor assembly method involves: an arrangement step in which a bundle (2) is arranged such that an external travel device (31) can travel on a base surface (25) and an internal travel device can travel on the inner peripheral surface (12) of a casing (3); a vertical position adjustment step in which, while measuring the relative positions in the vertical direction of the inner peripheral surface (12) of the casing (3) and the outer peripheral surface (13) of the bundle (2) at the opening (15) of the casing, the height position of the bundle (2) supported by the outside travel device (31) is adjusted on the basis of the measured relative positions in the vertical direction; and an insertion step in which the
(Continued)

bundle (2) is inserted into the casing (3) while the vertical position adjustment step is performed.

9 Claims, 11 Drawing Sheets

(51) Int. Cl.

| | |
|---|---|
| ***F04D 29/60*** | (2006.01) |
| ***F04D 29/28*** | (2006.01) |
| ***F04D 29/62*** | (2006.01) |
| ***F04D 29/64*** | (2006.01) |
| ***F04D 29/32*** | (2006.01) |
| ***F04D 19/00*** | (2006.01) |
| ***F04D 17/10*** | (2006.01) |
| ***F04D 17/12*** | (2006.01) |

(52) U.S. Cl.
CPC ..... *F04D 29/26* (2013.01); *F04D 29/403* (2013.01); *F04D 29/624* (2013.01); *F04D 29/644* (2013.01); *Y10T 29/49247* (2015.01)

(56) References Cited

U.S. PATENT DOCUMENTS

| | | | | |
|---|---|---|---|---|
| 3,942,908 | A | 3/1976 | Pilarczyk | |
| 3,963,371 | A | 6/1976 | Sieghartner | |
| 4,050,660 | A | 9/1977 | Eggmann et al. | |
| 4,053,255 | A | 10/1977 | Taylor | |
| 4,098,558 | A | 7/1978 | Bush et al. | |
| 4,116,583 | A | 9/1978 | Budris | |
| 4,218,181 | A | 8/1980 | Komatsu et al. | |
| 4,536,128 | A | 8/1985 | Feldle et al. | |
| 4,630,994 | A | 12/1986 | Gröss | |
| 4,715,778 | A | 12/1987 | Katayama et al. | |
| 5,846,052 | A | 12/1998 | Kameda | |
| 5,971,702 | A * | 10/1999 | Afton | B23P 19/022 29/888.011 |
| 2003/0021681 | A1 | 1/2003 | Gregory | |
| 2009/0214332 | A1 | 8/2009 | Towsley et al. | |
| 2009/0246039 | A1 | 10/2009 | Haack et al. | |
| 2009/0288291 | A1 | 11/2009 | Ziekow et al. | |
| 2011/0052426 | A1 | 3/2011 | Borer et al. | |
| 2012/0163962 | A1 | 6/2012 | Mariotti | |
| 2012/0243982 | A1 * | 9/2012 | Sasaki | F04D 17/122 415/200 |
| 2013/0266440 | A1 | 10/2013 | Ota et al. | |

FOREIGN PATENT DOCUMENTS

| | | | |
|---|---|---|---|
| EP | 0 101 915 | A2 | 3/1984 |
| EP | 0 766 007 | A1 | 4/1997 |
| EP | 0 840 016 | A2 | 5/1998 |
| EP | 1 158 178 | A1 | 11/2001 |
| EP | 2 045 472 | A1 | 4/2009 |
| EP | 2 400 161 | A2 | 12/2011 |
| EP | 2 474 743 | A2 | 7/2012 |
| EP | 2 479 437 | A2 | 7/2012 |
| JP | 47-12527 | A | 6/1972 |
| JP | 57-140598 | A | 8/1982 |
| JP | 2-72400 | U | 6/1990 |
| JP | 3009353 | U | 4/1995 |
| JP | 11-270499 | A | 10/1999 |
| JP | 2000-38988 | A | 2/2000 |
| JP | WO2005/015538 | A1 | 2/2005 |
| JP | 2005-282720 | A | 10/2005 |
| JP | 2009-513863 | A | 4/2009 |
| JP | 2011-174422 | A | 9/2011 |
| JP | 2011-220307 | A | 11/2011 |
| JP | 2012-177331 | A | 9/2012 |
| JP | 2012-177337 | A | 9/2012 |
| JP | 2013-174164 | A | 9/2013 |
| WO | WO 2007/048584 | A1 | 5/2007 |
| WO | WO 2012/114555 | A1 | 8/2012 |

OTHER PUBLICATIONS

International Search Report, dated Dec. 17, 2013, for International Application No. PCT/JP2013/076833, with an English translation.
Written Opinion of the International Searching Authority, dated Dec. 17, 2013, for International Application No. PCT/JP2013/076833, with an English translation.
Office Action dated Nov. 13, 2015 in counterpart European Application No. 13876723.1.

* cited by examiner

COMPRESSOR ASSEMBLY METHOD, AND BUNDLE GUIDING DEVICE

TECHNICAL FIELD

The present invention relates to an assembly method for a compressor formed by a bundle being inserted into a casing, and a bundle guiding device that guides the bundle into the casing.

Priority is claimed on Japanese Patent Application No. 2013-037317, filed Feb. 27, 2013, the content of which is incorporated herein by reference.

BACKGROUND ART

There are known vertical division type compressors in which a pillar-shaped bundle having a rotor, blades, or the like housed therein is inserted into or extracted from a tubular casing from an axis direction.

In such vertical division type compressors, if an outer peripheral surface of the bundle comes into contact with an inner peripheral surface of the casing when the bundle is inserted into the casing, the inner peripheral surface of the casing or the like may be damaged. When the inner peripheral surface of the casing or the like becomes damaged, there is a problem in that the airtightness of the compressors degrades.

PTL 1 suggests a bundle guiding device including a pair of left and right internal rollers that are disposed on a lower side of a front portion of a bundle in the direction of insertion, and a carriage that is disposed at a rear portion of the bundle in the direction of insertion. According to this bundle guiding device, it is possible to insert the bundle into the casing while correcting a tilt angle such that a relative angular difference between an axis of the bundle and an axis of the casing becomes a predetermined angular difference.

CITATION LIST

Patent Literature

[PTL 1] Japanese Unexamined Patent Application Publication No. 2011-220307

SUMMARY OF INVENTION

Technical Problem

Meanwhile, even if the above-described vertical division type compressor is a large-sized one in which the external diameter of the bundle exceeds 2 m, the clearance between the casing and the bundle is less than 1 mm in many cases.

Therefore, even if the relative angular difference between the bundle and the casing is made to be within a predetermined angle using the above-described bundle guiding device, the bundle may come into contact with the casing when the height position or the horizontal position of the axis of the bundle and the axis of the casing has shifted.

Since the clearance between the casing and the bundle is very small, skill is required for the work of aligning between the casing and the bundle, and there is a problem in that the working hours required for inserting of the bundle are prolonged.

The invention provides a compressor assembly method and a bundle guiding device that can easily insert a bundle into a casing while preventing contact between the casing and the bundle without requiring a worker's skill, and can shorten working hours spent when the bundle is inserted into the casing.

Solution to Problem

According to a first aspect of the invention, there is provided an assembly method for an compressor including a bundle having a rotor; and a casing into which the bundle is inserted, the bundle being inserted into the casing, using a guiding device including an internal travel device capable of supporting a front end portion of the bundle in the direction of insertion and capable of traveling on an inner peripheral surface of the casing, and an external travel device capable of supporting a rear end portion of the bundle in the direction of insertion and capable of traveling on a base surface extending from an opening of the casing toward the rear in the direction of insertion. The assembly method for a compressor includes an arrangement step of arranging the bundle such that the external travel device is capable of traveling on the base surface and the internal travel device is capable of traveling on the inner peripheral surface of the casing; a vertical position adjustment step of, while measuring relative positions in a vertical direction of the inner peripheral surface of the casing and an outer peripheral surface of the bundle at the opening of the casing, adjusting a height position of the bundle supported by the external travel device on the basis of the measured relative positions in the vertical direction; and an insertion step of inserting the bundle into the casing while the vertical position adjustment step is performed.

In the assembly method for the compressor according to a second aspect of the invention, in the assembly method for the compressor according to the first aspect, the height of the bundle may be adjusted using a height adjustment jack provided between the external travel device and the bundle.

According to a third aspect of the invention, in the compressor assembly method according to the first or second aspect, the assembly method for a compressor may further include a horizontal position adjustment step of, while measuring relative positions in a horizontal direction of the inner peripheral surface of the casing and the outer peripheral surface of the bundle at the opening of the casing, adjusting a horizontal position of the bundle supported by the external travel device on the basis of measured relative positions in the horizontal direction.

According to a fourth aspect of the invention, in the compressor assembly method according to any one of the first to third aspects, the assembly method for a compressor may further include a relative angle adjustment step of, while measuring relative angles of the casing and the bundle, adjusting the relative angle of the bundle supported by the external travel device on the basis of the measured relative angles.

According to a fifth aspect of the invention, in a bundle guiding device for a compressor including a bundle having a rotor, and a casing into which the bundle is inserted. The bundle guiding device may include an internal travel device provided in a front end portion of the bundle in the direction of insertion of the bundle and capable of traveling on an inner peripheral surface of the casing. The bundle guiding device may further include an external travel device provided in a rear end portion of the bundle in the direction of insertion and capable of traveling on a base surface extending from an opening of the casing toward the rear in the direction of insertion. The bundle guiding device may further include a position detection unit that is disposed at the opening of the casing to detect relative positions of the outer peripheral surface of the bundle and the inner peripheral surface of the casing and a position adjustment mechanism that adjusts the position of the bundle supported by the external travel device. The bundle guiding device may further include a position adjustment control unit that controls position adjustment using the position adjustment mechanism on the basis of the position detected by the position detection unit.

According to a sixth aspect of the invention, in the bundle guiding device for a compressor according to the fifth aspect of the invention, the bundle guiding device may further include a moving mechanism that moves the bundle in a direction in which the bundle is inserted into the casing. The position adjustment control unit may determine whether or not a distance between the outer peripheral surface of the bundle and the inner peripheral surface of the casing falls below a preset threshold, on the basis of the detection performed by the position detection unit. When it is determined that the distance falls below the threshold, the position adjustment control unit may allow the moving mechanism to stop the movement of the bundle in the direction of insertion and may allow the position adjustment mechanism to perform the position adjustment of the bundle in a direction which the distance between the outer peripheral surface of the bundle and the inner peripheral surface of the casing increases.

Advantageous Effects of Invention

According to the above-described compressor assembly method and the above-described bundle guiding device, the bundle can be easily inserted into the casing, while preventing contact between the casing and the bundle without requiring a worker's skill. Moreover, according to the above-described compressor assembly method and the above-described bundle guiding device, the working hours spent when the bundle is inserted into the casing can be shortened.

DESCRIPTION OF EMBODIMENTS

Hereinafter, a compressor assembly method and a bundle guiding device related to a first embodiment of the invention will be described.

Figure 1:
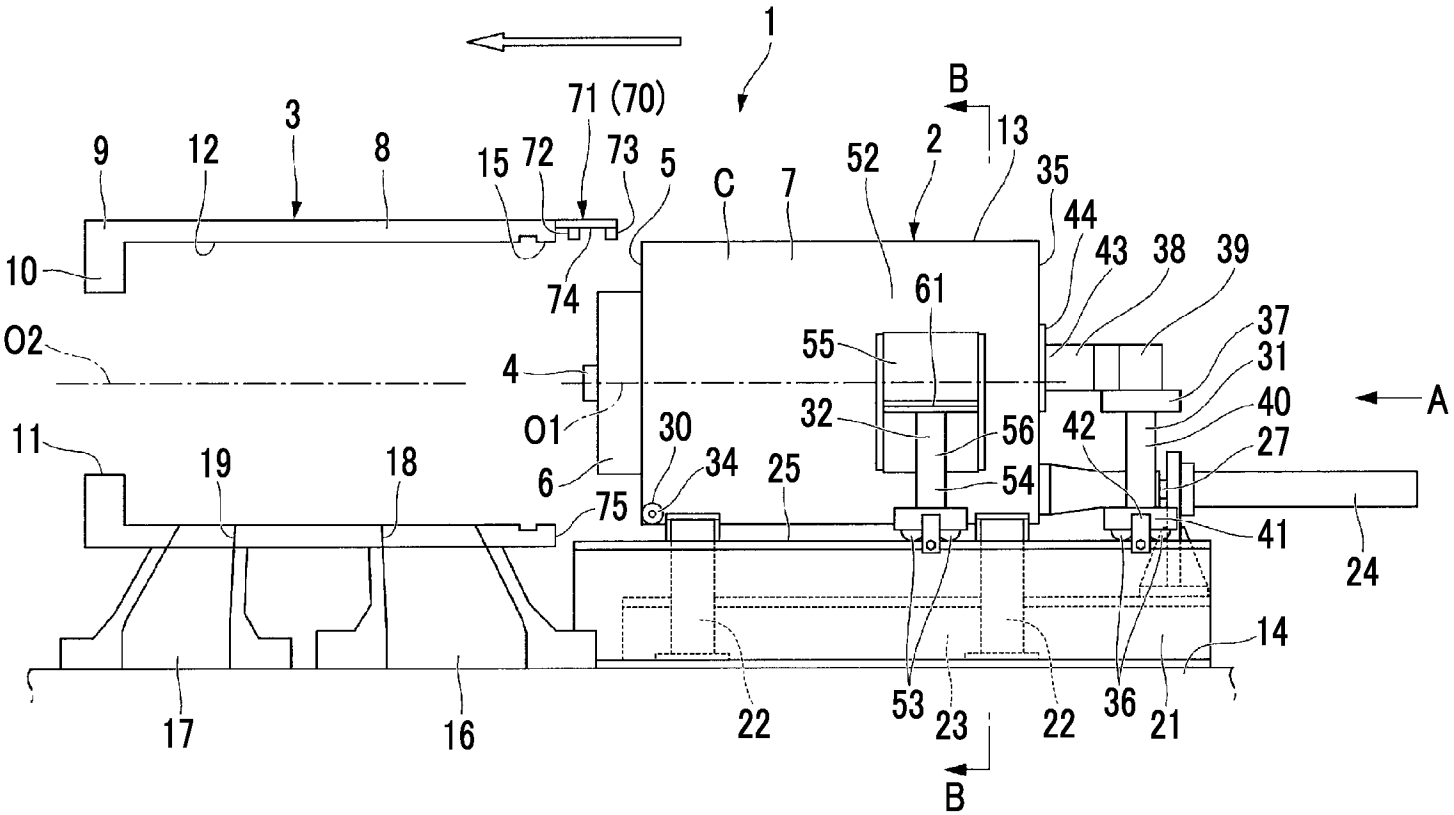
FIG. 1 is a side view illustrating a compressor and a bundle guiding device in a first embodiment of the invention.

FIG. 1 illustrates a compressor and the bundle guiding device of the first embodiment.

A compressor 1 is a so-called vertical division type compressor, and includes a bundle 2 and a casing 3.

The bundle 2 has therein a rotor 4, and a stationary part C that rotatably supports the rotor 4. The bundle 2 is formed in a pillar shape, more specifically, in a columnar shape, which is centered on an axis O1 of the rotor 4. The bundle 2 includes a positioning convex portion 6 that protrudes forward from a front end portion 5 in the direction of insertion. The positioning convex portion 6 is formed in an annular shape having a smaller diameter than a body portion 7 of the bundle 2. In addition, the insertion direction of the bundle 2 in FIG. 1 is indicated by an arrow.

The casing 3 is a member into which the bundle 2 is inserted. The casing 3 includes a tubular outer peripheral wall 8, and a bottom wall 10 that radially extends inward from a front end portion 9 of the outer peripheral wall 8 in the direction of insertion. A circular hole portion 11 centered on an axis O2 of the casing 3 is formed at a central portion of the bottom wall 10. The hole portion 11 is formed to have a slightly larger diameter than the above-described positioning convex portion 6, and enables the positioning convex portion 6 to fit thereto. Although illustration is omitted, an inner peripheral surface 12 of the casing 3 and an outer peripheral surface 13 of the bundle 2 are formed in a slightly tapered shape toward a front side in the direction of insertion. The diameter of the inner peripheral surface 12 of the casing 3 is made to be slightly larger (for example, less than 1 mm or the like) than the diameter of the outer peripheral surface 13 that faces the inner peripheral surface 12 of the bundle 2 in a state where insertion of the bundle into the casing 3 is completed.

The casing 3 is fixed onto a platform 14 such that the direction of the axis O2 is in a horizontal direction. The casing 3 has an opening 15 for allowing the bundle 2 to be inserted into and detached therefrom, on a side opposite to the bottom wall 10 in the direction of the axis O2. The outer peripheral wall 8 of the casing 3 includes a suction nozzle 16 and a discharge nozzle 17. The suction nozzle 16 and the discharge nozzle 17 are disposed under the outer peripheral wall 8 in a state where the casing 3 is fixed onto the platform 14. The suction nozzle 16 and the discharge nozzle 17 are respectively formed in a tubular shape that is increased in diameter downward. The suction nozzle 16 is arranged closer to the opening 15 side than the discharge nozzle 17 in the direction of the axis O2. The suction nozzle 16 and the discharge nozzle 17 respectively include through-holes 18 and 19 that pass through the outer peripheral wall 8.

Figure 2:
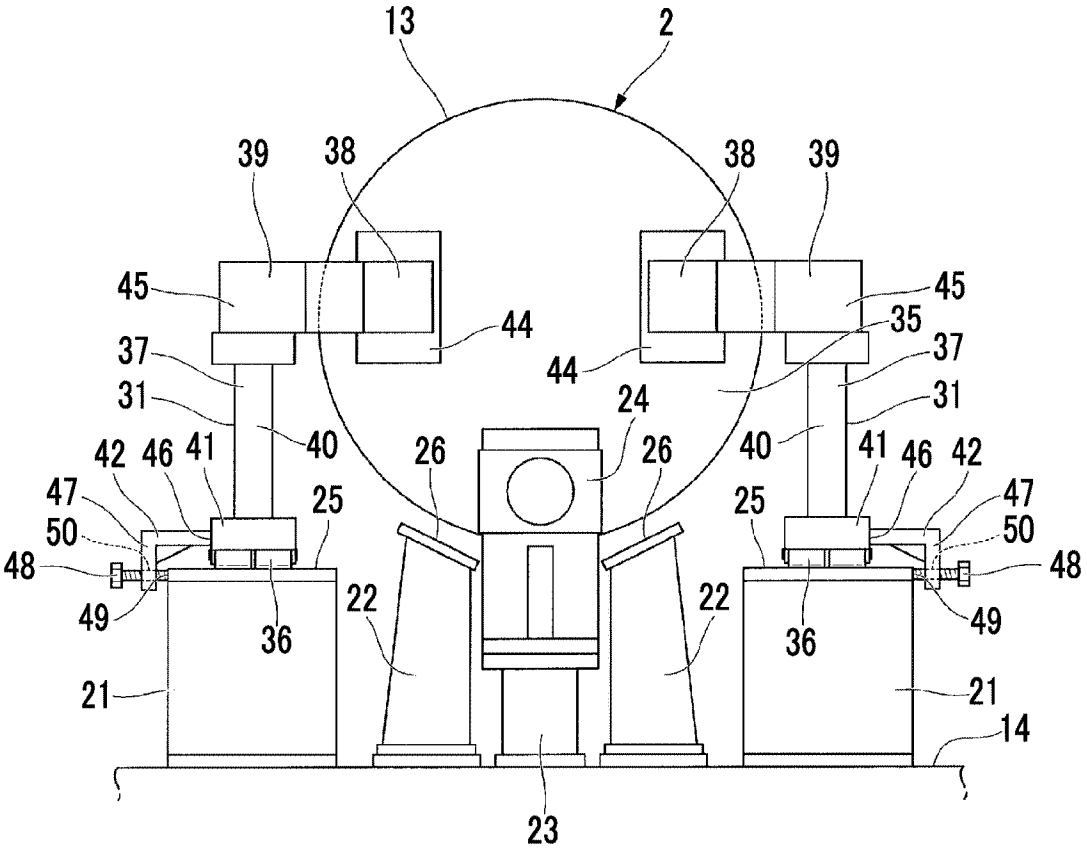
FIG. 2 is a view as seen from direction A of FIG. 1 in the first embodiment of the invention.

As illustrated in FIGS. 1 and 2, the bundle guiding device of this embodiment includes a pair of rail members 21, a pair of cradles 22, a cylinder rail 23, and a cylinder (moving mechanism) 24.

The pair of rail members 21 are members that form tracks for inserting the bundle 2 into the casing 3 outside the casing 3. The rail members 21 are laid along an extension line of the axis O2 of the casing 3 on the platform 14. The rail members 21 are laid so as to extend in a direction away from the opening 15 of the casing 3. The upper surface (base surface) 25 of the rail members 21 is formed as a horizontal surface. The rail members 21 extend parallel to each other at almost the same distance as the diameter of the bundle 2.

The cradle 22 is a member for temporarily placing the bundle 2 before being inserted into the casing 3. A plurality (for example, two) of the cradles 22 are installed on the platform 14 inside the tracks of the pair of rail members 21, in a state where the cradles are separated from each other in the direction of the axis O1 of the bundle 2. The cradles 22 respectively have inclined surfaces 26, which face the outer peripheral surface 13 of the bundle 2, on upper portions thereof. The inclined surfaces 26 incline in directions that go down toward the center of the tracks, which are formed by the rail members 21, in a width direction.

The cylinder 24 is a device for pressing the bundle 2 against the casing 3 side. In the cylinder 24, an inner rod 27 is extendable and retractable (refer to FIG. 1) using fluid pressure, such as hydraulic pressure.

The cylinder rail 23 is a rail for supporting the cylinder 24. The cylinder rail 23 is laid along the rail members 21 on the platform 14 inside the tracks of the rail members 21. The cylinder rail 23 has fixing parts (not illustrated), which are capable of detachably supporting the cylinder 24, in a plurality of places in a longitudinal direction thereof. As the cylinder rail 23 has the plurality of fixing parts in this way, the cylinder 24 is enabled to be moved in the longitudinal direction of the rail members 21, in accordance with the position of the bundle 2 during insertion. That is, by gradually moving the supporting position of the cylinder 24 in the longitudinal direction of the cylinder rail 23 to the casing 3 side, the bundle 2 is enabled to be housed in the casing 3, using the cylinder 24 in which the stroke amount of the inner rod 27 is shorter than the distance by which the bundle 2 is moved.

The bundle guiding device in this embodiment includes a pair of internal travel devices 30, a pair of rear travel devices (external travel devices) 31, and a pair of intermediate travel devices 32.

Each internal travel device 30 is a device that supports the front end portion 5 of the bundle 2 in the direction of insertion and travels on the inner peripheral surface 12 of the casing 3. The internal travel device 30 is disposed at the front end portion 5 of the bundle 2, and includes an internal roller 34 that is rollable in the direction of insertion of the bundle 2. The internal roller 34 includes a cylindrical roller member. The internal roller 34 is rotatably supported by a bearing part (not illustrated) provided at a lower edge of the front end portion 5 of the bundle 2. Each internal roller 34 is attached so as to radially protrude outward slightly further than the outer peripheral surface 13 of the front end portion 5 of the bundle 2.

The respective internal rollers 34 of the pair of internal travel devices 30 are disposed so as to be separated from each other in the circumferential direction in a lower half portion of the bundle 2. Additionally, the pair of internal rollers 34 are respectively at positions symmetrical with respect to the meridian of the bundle 2 as an axis of symmetry, as seen from the direction of the axis O1. By providing the internal travel devices 30 in this way, it is possible to push the bundle 2 into the bottom wall 10 side of the casing 3 without interference of the front end portion 5 of the bundle 2 with the inner peripheral surface 12 of the casing 3. Similarly, when the bundle 2 is pulled out from the casing 3 for maintenance or the like, it is possible to move the front end portion 5 up to the opening 15 of the casing 3 without interference of the front end portion 5 of the bundle 2 with the inner peripheral surface 12 of the casing 3.

The pair of rear travel devices 31 are devices that support a rear end portion 35 of the bundle 2 in the direction of insertion in a travelable manner. Each rear travel device 31 is an external travel device that is provided outside the bundle 2, and includes a rear roller 36 and a rear leg member 37.

The rear roller 36 is a roller member that is rollable toward the insertion direction of the bundle 2 on the upper surface 25 of the rail member 21 provided outside the casing 3.

The rear leg member 37 is attachable to and detachable from the rear end portion 35 of the bundle 2, and rotatably supports the rear roller 36. The rear leg member 37 includes a rear extending part 38, a horizontal extending part 39, a rear jack (height adjustment jack) part 40, a rear roller support part 41, and a rear horizontal adjustment mechanism part 42.

The rear extending part 38 is formed so as to extend rearward in the direction of insertion of the bundle 2. The rear extending part 38 has a flange part 44, which is capable of being fixed to the rear end portion 35 of the bundle 2, at a front end portion 43 thereof. The flange part 44 is attachable to and detachable from the rear end portion 35 of the bundle 2 with bolts or the like.

The horizontal extending part 39 is formed so as to extend in a horizontal direction from a rear portion of the rear extending part 38 to a vertical upper position of the rail member 21.

The rear jack part 40 consists of a hydraulic jack or the like capable of lifting the rear end portion 35 of the bundle 2. Each rear jack part 40 is disposed between an outer end portion 45 of the horizontal extending part 39, and the rear roller support part 41.

The rear roller support part 41 is a frame that rotatably supports the rear roller 36, and has the rear horizontal adjustment mechanism part 42 attached to an outer surface 46 thereof.

The rear horizontal adjustment mechanism part 42 is a mechanism that adjusts the position of the rear travel device 31 in the horizontal direction to adjust the position of the rear end portion 35 of the bundle 2 in the horizontal direction. The rear horizontal adjustment mechanism part 42 includes an arm member 47 and a position adjusting bolt 48.

The arm member 47 is supported by an outer surface 46 of the rear roller support part 41, and is formed in an L shape so as to take a roundabout path to the outside of the track of the rail member 21. The arm member 47 has a screw hole 50 at a position that faces an outer surface 49 of the rail member 21.

The position adjusting bolt 48 is a member that presses the outer surface 49 of the rail member 21 from the outside of the track toward the inside of the track. The position adjusting bolt 48 is screwed into the screw hole 50 from the outside of the track. The position adjusting bolts 48 are enabled to press the outer surfaces 49 of the rail members 21 from the outsides of both the tracks, in accordance to the degree of being screwed into the screw holes 50.

According to the rear horizontal adjustment mechanism part 42, by adjusting the degree of being screwed of each position adjusting bolt 48 to press one of the outer surfaces 49 of the outer surfaces 49 of the pair of rail members 21, the rear travel device 31 can be moved to any one of the tracks in a leftward-rightward direction by a reaction force against the pressing. As a result, the horizontal position of the rear end portion 35 of the bundle 2 with respect to the casing 3 can be adjusted.

Figure 3:
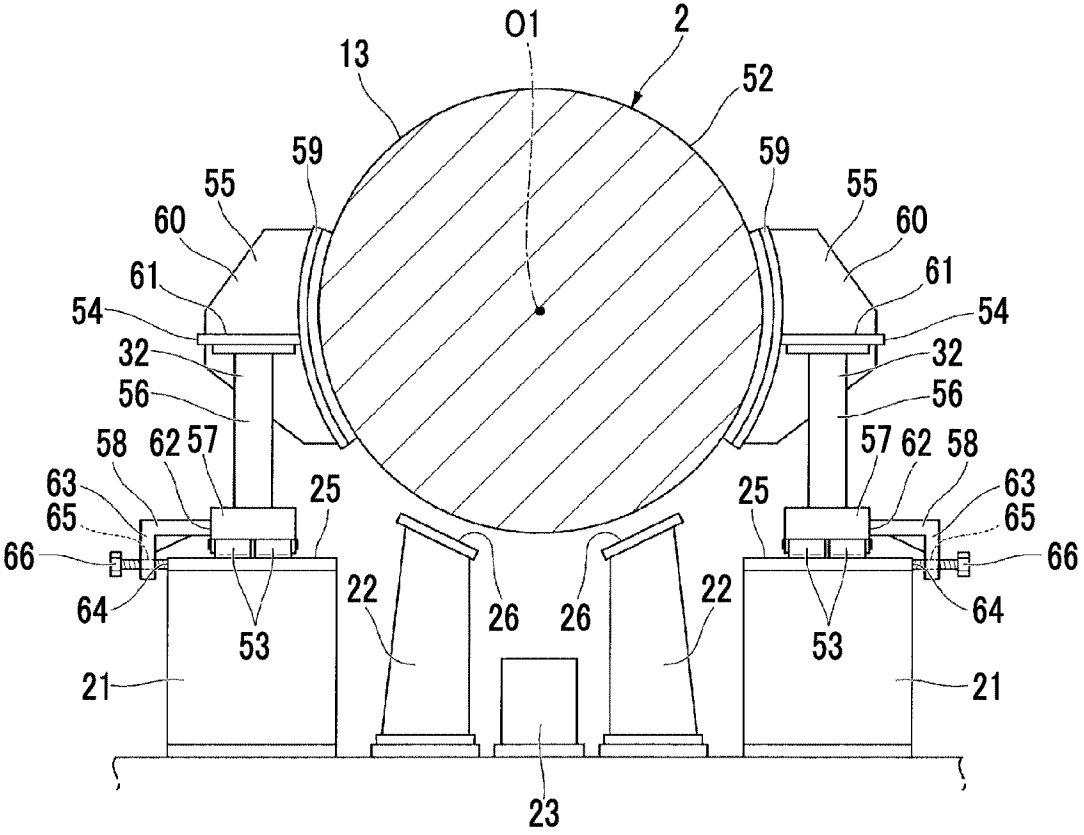
FIG. 3 is a cross-sectional view taken along line B-B of FIG. 1 in the first embodiment of the invention.

As illustrated in FIGS. 1 and 3, the pair of intermediate travel devices 32 support an intermediate portion 52 of the bundle 2 between the front end portion 5 supported by the internal travel devices 30 and the rear end portions 35 supported by the rear travel devices 31, in the direction of insertion of the bundle 2. Each intermediate travel device 32 is an external travel device that is provided outside the bundle 2, and includes an intermediate roller 53 and an intermediate leg member 54.

The intermediate roller 53, similar to the rear roller 36, is a roller member that is rollable toward the longitudinal direction of the rail member 21 on the upper surface 25 of the rail member 21.

The intermediate leg member 54 is attachable to and detachable from the outer peripheral surface 13 of the intermediate portion 52 of the bundle 2, and rotatably supports the intermediate roller 53. The intermediate leg member 54 includes an attachment bracket part 55, an intermediate jack (height adjustment jack) part 56, an intermediate roller support part 57, and an intermediate horizontal adjustment mechanism part 58.

The attachment bracket part 55 includes a fastening part 59 and an overhanging part 60. The fastening part 59 is formed to be bent along the outer peripheral surface 13 of the bundle 2, and is attachable to and detachable from the intermediate portion 52 of the bundle 2 with bolts or the like. The overhanging part 60 includes an attachment seat portion 61 that is formed such that bundle 2 extends radially outward from the fastening part 59 and to which an upper end of the intermediate jack part 56 is fixed.

The intermediate jack part 56, similar to the rear jack part 40, consists of a hydraulic jack that can lift the intermediate portion 52 of the bundle 2. Each intermediate jack part 56 is disposed between the attachment seat portion 61 of the attachment bracket part 55, and the intermediate roller support part 57.

Similar to the above-described rear horizontal adjustment mechanism part 42, the intermediate horizontal adjustment mechanism part 58 is supported by an outer surface 62 of the intermediate roller support part 57, and includes an arm member 63 that is formed so as to take a roundabout path to the outside of the track of the rail member 21. The arm member 63 has a screw hole 65 at a position that faces an outer surface 64 of the rail member 21. A position adjusting bolt 66 is screwed into the screw hole 65 from the outside of the track. An end portion of the position adjusting bolt 66 protrudes to the rail member 21 side. That is, similar to the above-described rear horizontal adjustment mechanism part 42, by adjusting the degree of being screwed of each position adjusting bolt 66 of the intermediate horizontal adjustment mechanism part 58, the position of the intermediate portion 52 of the bundle 2 with respect to the casing 3, specifically, the position in the horizontal direction orthogonal to the insertion direction is enabled to be adjusted.

Figure 9:
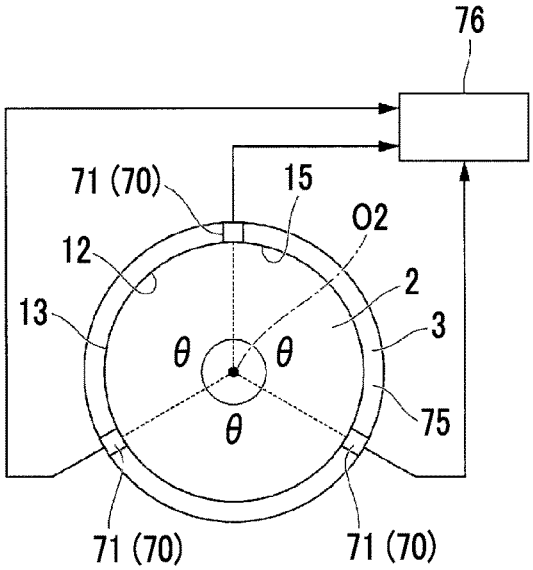
FIG. 9 is a view illustrating the arrangement of a position detection unit in the first embodiment of the invention when the casing is seen from an axis direction.

As illustrated in FIGS. 1 and 9, the bundle guiding device of this embodiment includes a position detection unit 70. The position detection unit 70 is a device that detects a distance between the inner peripheral surface 12 of the casing 3 and the outer peripheral surface 13 of the bundle 2. The position detection unit 70 in this embodiment has a plurality of, more specifically, three distance sensors 71 capable of detecting the distance to an object to be detected in a contactless manner. As illustrated in FIG. 1, each distance sensor 71 includes a front sensor 72, a rear sensor 73, and a bracket 74. The bracket 74 is a member for fixing the front sensor 72 and the rear sensor 73 to the casing 3. The bracket 74 is attached to a peripheral edge 75 of the opening 15. The bracket 74 is formed so as to extend along the extension line of the axis O2 of the casing 3 parallel to the extension line. The brackets 74 are disposed at equal intervals in the circumferential direction of the casing 3, and the angle θ formed between the brackets 74 adjacent to each other centered on the axis O2 is at 120 degrees. One of the three distance sensors 71 is arranged vertically above the axis O2.

One front sensor 72 and one rear sensor 73 are attached to one bracket 74. The front sensor 72 and the rear sensor 73 attached to one bracket 74 are arranged at a distance (for example, several centimeters) from each other in the direction of the axis O2. The front sensor is arranged on a front side of the bundle 2 in the direction of insertion, in the longitudinal direction in which the bracket 74 extends. The rear sensor 73 is arranged on a rear side of the front sensor 72 in the direction of insertion.

The front sensor 72 and the rear sensor 73 emit laser light or the like toward a radial inner side of the casing 3, respectively, and measures the distance from an object, that is, the bundle 2. The measurement results of the front sensor 72 and the rear sensor 73 are input to a display control unit 76 (refer to FIG. 9). Here, the distance measured by the front sensor 72 is a distance between the front sensor 72 and the object to be measured. The distance measured by the rear sensor 73 is a distance between the rear sensor 73 and the object to be measured.

Figure 10:
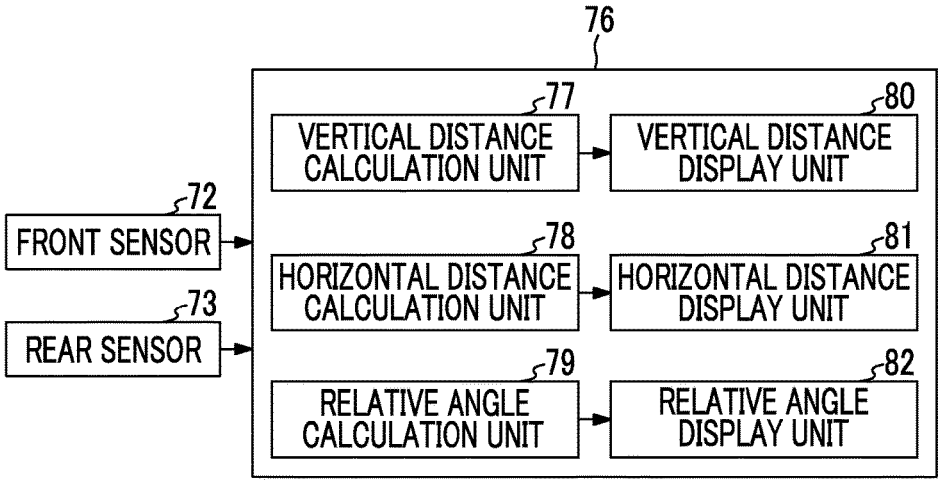
FIG. 10 is a block diagram illustrating a schematic configuration of a display control unit in the first embodiment of the invention.
Figure 11:
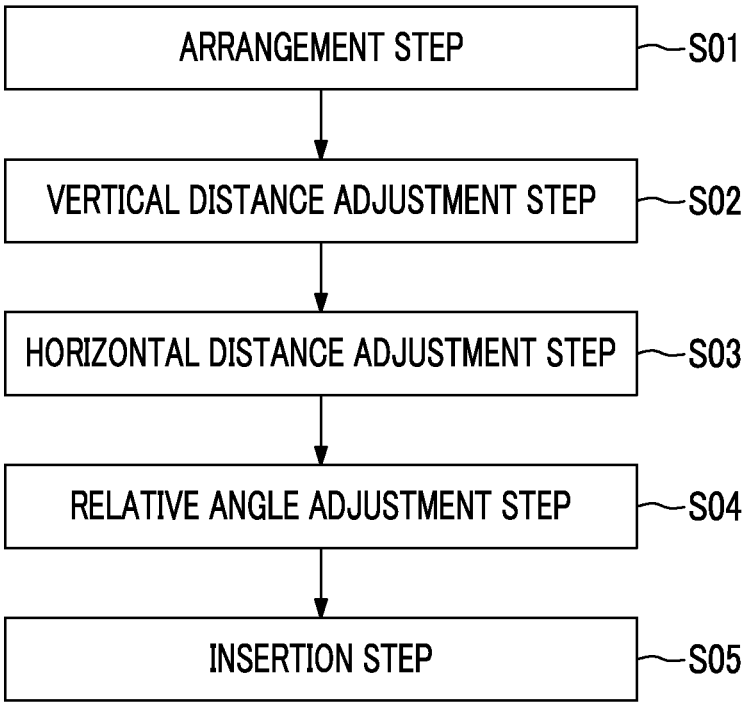
FIG. 11 is a flowchart illustrating respective steps of the bundle assembly method in the first embodiment of the invention.

The display control unit 76 obtains and displays the distance or angle between the inner peripheral surface 12 of the casing 3 and the outer peripheral surface 13 of the bundle 2, on the basis of the measurement result of each front sensor 72 and the measurement result of each rear sensor 73. As illustrated in FIG. 10, the display control unit 76 includes a vertical distance calculation unit 77, a horizontal distance calculation unit 78, a relative angle calculation unit 79, a vertical distance display unit 80, a horizontal distance display unit 81, and a relative angle display unit 82. For example, a personal computer or the like can be used as the display control unit 76. The vertical distance calculation unit 77, the horizontal distance calculation unit 78, and the relative angle calculation unit 79 can consist of software capable of being executed by a personal computer. In this case, a display of the personal computer can be used as the vertical distance display unit 80, the horizontal distance display unit 81, and the relative angle display unit 82.

The vertical distance calculation unit 77 obtains a distance in the vertical direction between the outer peripheral surface 13 of the bundle 2 and the inner peripheral surface 12 of the casing 3 at the position of the opening 15 of the casing 3. More specifically, the vertical distance calculation unit 77 obtains a distance in the vertical direction between the outer peripheral surface 13 and the inner peripheral surface 12, on the basis of the measurement result of the front sensor 72 that is disposed vertically above the axis O2. A calculation result obtained through vertical distance calculation is output toward the vertical distance display unit 80 as distance information.

Here, the positional relationship between the attachment position of the front sensor 72 in the radial direction of the casing 3 and the inner peripheral surface of the casing 3 in the immediate vicinity of the attachment position can be obtained in advance. Therefore, in the vertical distance calculation unit 77, a distance in the radial direction between the outer peripheral surface 13 and the inner peripheral surface 12 in a place to which the front sensor 72 is attached is obtained from the positional relationship between the inner peripheral surface 12 and the front sensor 72 and information on the distance measured by the front sensor 72.

The horizontal distance calculation unit 78 obtains a distance in the horizontal direction between the outer peripheral surface 13 of the bundle 2 and the inner peripheral surface 12 of the casing 3 at the position of the opening 15 of the casing 3. More specifically, the distance in the horizontal direction between the outer peripheral surface 13 of the bundle 2 and the inner peripheral surface 12 of the casing 3 at the opening 15 is obtained, on the basis of the measurement results of the two front sensors 72 excluding the front sensor 72 disposed vertically above the axis O2, among the three front sensors 72 that are disposed at intervals in the circumferential direction of the casing 3.

Here, the distances in the radial direction between the inner peripheral surface 12 of the casing 3 and the outer peripheral surface 13 of the bundle 2 at respective circumferential positions where the two front sensors 72 are disposed have proportional relationships with respective distances in the horizontal direction between the inner peripheral surface 12 of the casing 3 and the outer peripheral surface 13 of the bundle 2 immediately above the circumferential positions. Therefore, the respective distances in the radial direction between the inner peripheral surface 12 of the casing 3 and the outer peripheral surface 13 of the bundle 2 on both sides of the opening 15 in the horizontal direction of the axis O2 can be obtained by the two front sensors 72. The calculation result of the horizontal distance calculation unit 78 is output toward the horizontal distance display unit 81 as distance information.

The relative angle calculation unit 79 obtains the angle of the bundle 2 relative to the casing 3, on the basis of the measurement results of the front sensor 72 and the rear sensor 73 of each distance sensor 71. Here, the relative angles of the outer peripheral surface 13 of the bundle 2 and the inner peripheral surface 12 of the casing 3 at a measurement position in the circumferential direction are obtained by calculating the deviation between the distances that are respectively measured by the front sensor 72 and the rear sensor 73 of the same distance sensor 71. The relative angle calculation unit obtains the relative angles of the bundle 2 and the casing 3 according to expressions, tables, maps, or the like, on the basis of relative angles in respective measurement positions. The calculation result of the relative angle calculation unit 79 is output to the relative angle display unit 82 as angle information.

The vertical distance display unit 80 displays the distance information input from the above-described vertical distance calculation unit 77.

The horizontal distance display unit 81 displays the distance information input from the above-described horizontal distance calculation unit 78.

The relative angle display unit 82 displays the angle information input from the above-described relative angle calculation unit 79.

Next, the assembly method for the compressor 1 of the above-described first embodiment will be described referring to a flowchart of FIG. 11, and FIGS. 1 to 8.

Figure 4:
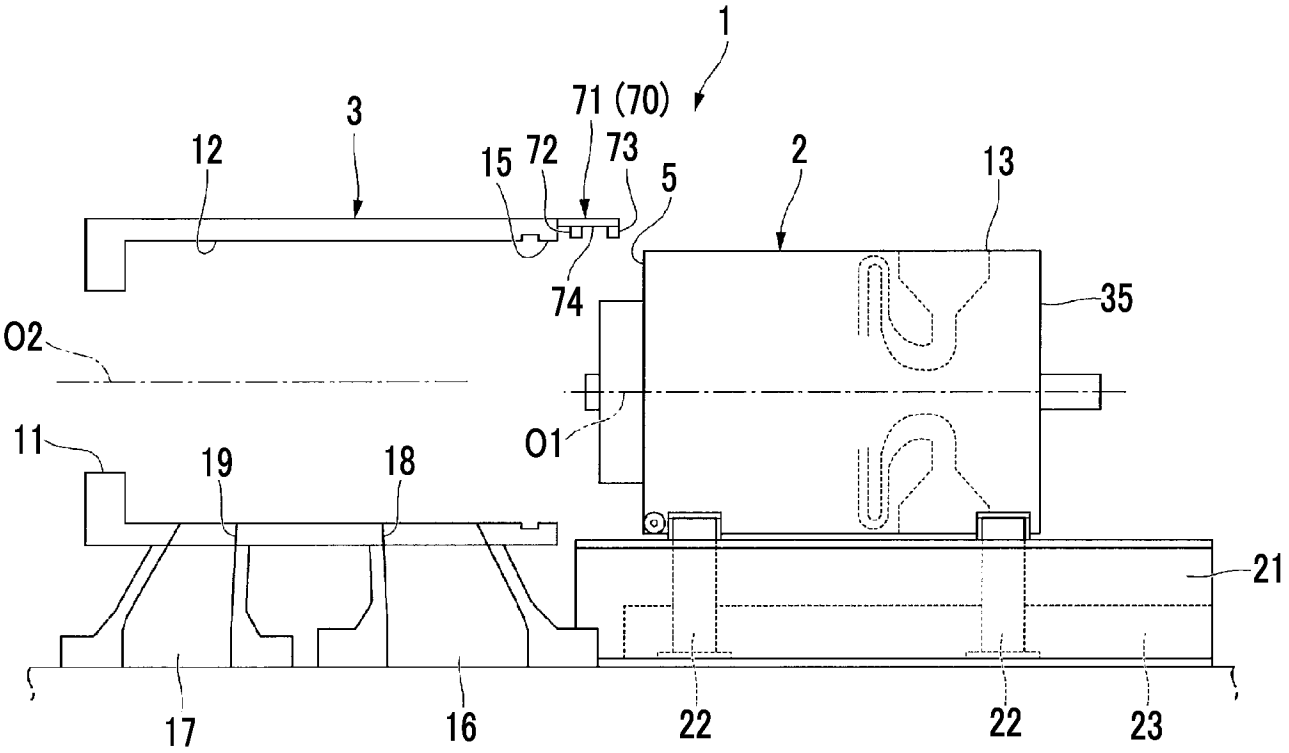
FIG. 4 is a side view equivalent to FIG. 1 before rear travel devices and intermediate travel devices in the first embodiment of the invention are mounted.
Figure 5:
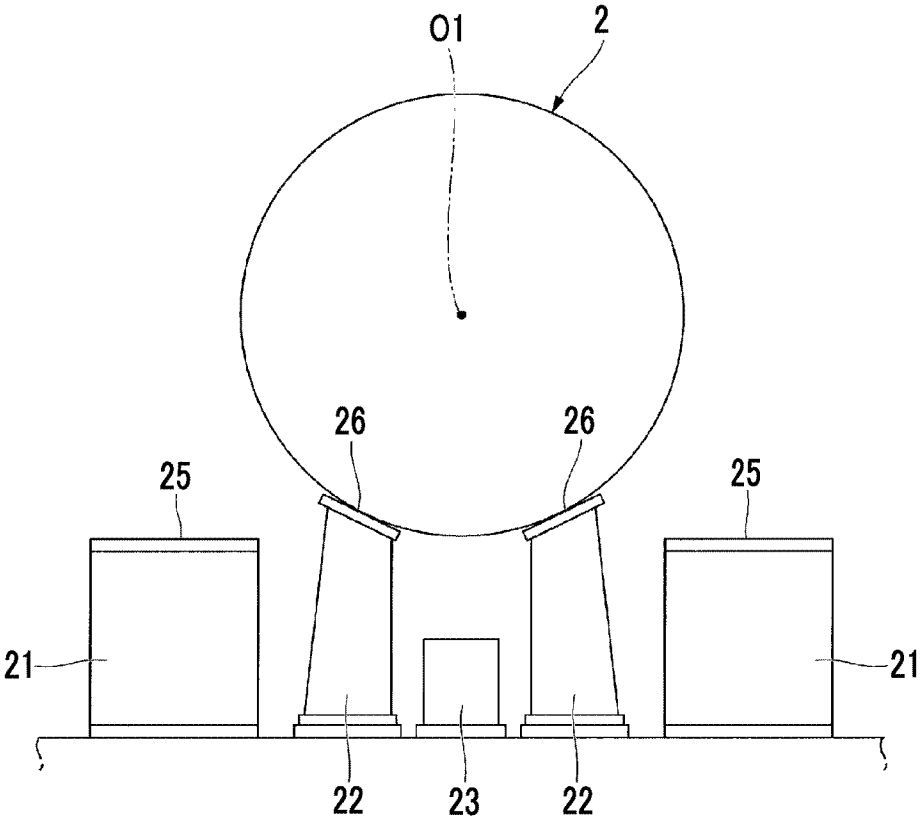
FIG. 5 is a view as seen in the direction of the arrow, which is equivalent to FIG. 2 before the rear travel devices and the intermediate travel devices in the first embodiment of the invention are mounted.

First, an arrangement step of arranging the bundle 2 behind the opening 15 of the casing 3 in the direction of insertion is performed (Step S01). In this arrangement step, as illustrated in FIGS. 4 and 5, the bundle 2 is installed on the cradles 22 such that the axis O1 is parallel to the insertion direction. In this arrangement step, the intermediate leg members 54 and the rear leg members 37 are attached to the bundle 2, respectively, such that the intermediate rollers 53 and the rear rollers are arranged on the upper surfaces 25 of the rail members 21.

In the above arrangement step, as illustrated in FIG. 3, the height position of the bundle 2 is raised by the rear jack parts 40 and the intermediate jack parts 56, thereby adjusting the height position of the axis O1 of the bundle 2 and the height position the axis O2 of the casing 3 so as to coincide with each other. By adjusting the height position of the bundle 2 using the rear jack parts 40 and the intermediate jack parts 56 in this way, the bundle 2 changes from a state where the bundle 2 is supported by the cradles 22 to a state where the bundle is supported by the intermediate travel devices 32 and the rear travel devices 31.

Moreover, in the arrangement step, the position of the axis O1 of the bundle 2 and the axis O2 of the casing in the horizontal direction are adjusted by the rear horizontal adjustment mechanism parts 42 and the intermediate horizontal adjustment mechanism parts 58 so as to coincide with each other. Additionally, in the arrangement step, a state is brought about in which the cylinder 24 is attached to the cylinder rail 23 and the rear end portion 35 of the bundle 2 is enabled to be pressed by the cylinder 24.

Figure 6:
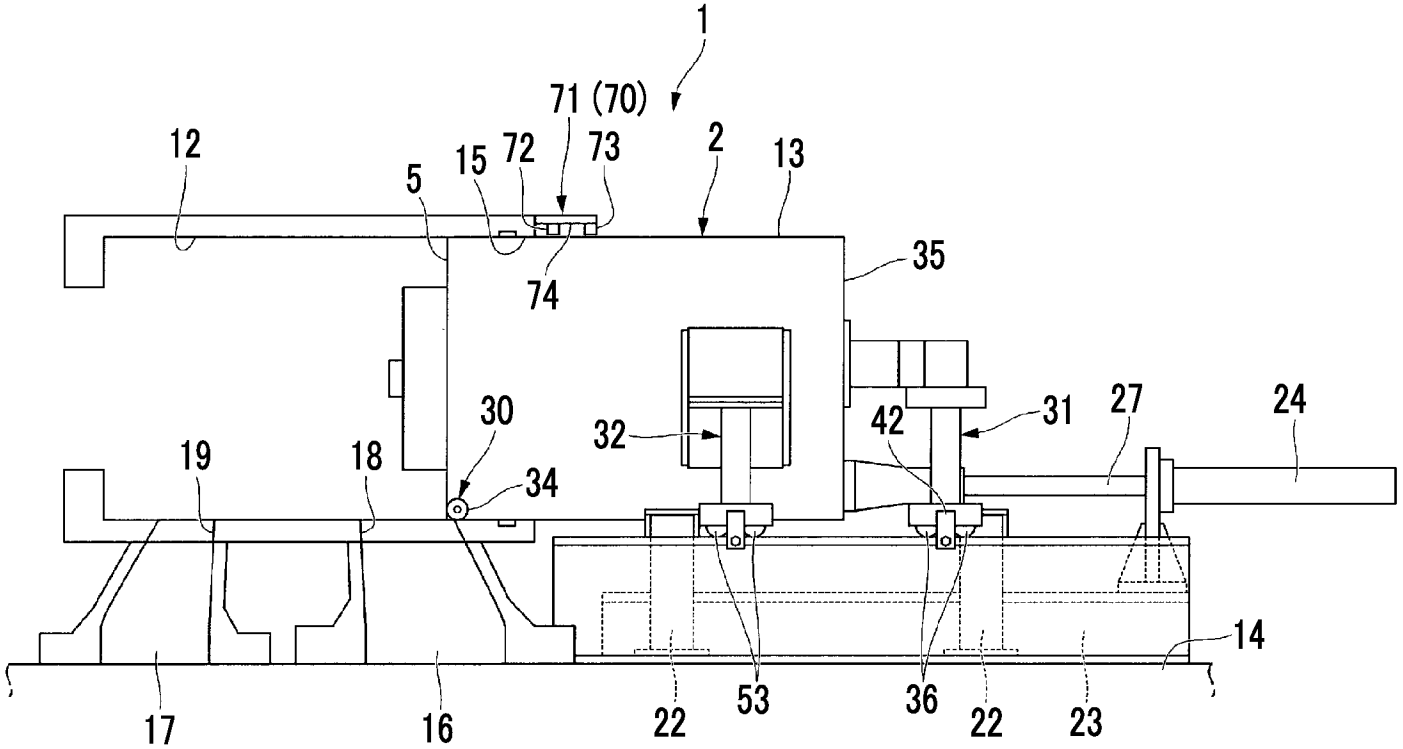
FIG. 6 is a side view equivalent to FIG. 1 illustrating a state immediately after an insertion step in the first embodiment of the invention is started.

Thereafter, in the arrangement step, the rear rollers 36 and the intermediate rollers 53 are rolled to insert the front end portion 5 of the bundle 2 into the opening 15 of the casing 3. More specifically, as illustrated in FIG. 6, the cylinder 24 is actuated to press the rear end portion 35 of the bundle 2 and roll the rear rollers 36 and the intermediate rollers 53 toward the insertion direction, that is, the longitudinal direction of the rail members 21, thereby moving the bundle 2 to the casing 3 side.

Next, a vertical position adjustment step of, while measuring relative positions in the vertical direction of the inner peripheral surface 12 of the casing 3 and the outer peripheral surface 13 of the bundle 2 at the opening 15 of the casing 3, adjusting the height position of the bundle 2 supported by the rear travel devices 31 on the basis of the measured relative positions in the vertical direction is performed (Step S02). Here, a worker performs the operation of the cylinder 24 while viewing a distance displayed on the vertical distance display unit 80, and when the distance displayed on the vertical distance display unit 80 falls below a predetermined distance that is specified in advance, the worker stops the movement of the bundle 2 by the cylinder 24. Thereafter, the worker adjusts the height of the rear end portion 35 of the bundle 2, using the rear jack parts 40 of the rear travel devices 31. By adjusting the height of the rear end portion 35 in this way, the intermediate travel devices 32 can serve as supporting points and can change the height of the front end portion 5 of the bundle 2.

Similarly, a horizontal position adjustment step of, while measuring relative positions in the horizontal direction of the inner peripheral surface 12 of the casing 3 and the outer peripheral surface 13 of the bundle 2 at the opening 15 of the casing 3, adjusting the horizontal position of the bundle 2 supported by the rear travel devices 31 and the intermediate travel devices 32 on the basis of the measured relative positions in the horizontal direction is performed (Step S03). In this horizontal position adjustment step, when the worker adjusts the horizontal position of the bundle 2, the operator performs adjustment work while viewing a distance displayed on the horizontal distance display unit 81. Specifically, when the distance displayed on the horizontal distance display unit 81 falls below a predetermined distance that is specified in advance, the worker stops the movement of the bundle 2 by the cylinder 24, similar to the above vertical position adjustment step. Thereafter, the worker operates the rear horizontal adjustment mechanism parts 42 and the intermediate horizontal adjustment mechanism parts 58 to adjust the position of the bundle 2 in the horizontal direction while viewing the horizontal distance display unit 81 such that the distances between the inner peripheral surface 12 and the outer peripheral surface 13 on both sides in the horizontal directions are equal to or more than a predetermined distance, respectively.

Additionally, similarly, a relative angle adjustment step of, while measuring the relative angles of the casing 3 and the bundle 2, adjusting the relative angle of the bundle 2 supported by the rear travel devices 31 on the basis of the measured relative angles is performed (Step S04). In this relative angle adjustment step, the worker performs adjustment work while viewing the relative angles displayed on the relative angle display unit 82. Specifically, when the relative angles displayed on the relative angle display unit 82 exceed a predetermined relative angle that is specified in advance, the worker stops the movement of the bundle 2 by the cylinder 24. Thereafter, the worker appropriately operates the rear jack parts 40, the intermediate jack parts 56, the rear horizontal adjustment mechanism parts 42, and the intermediate horizontal adjustment mechanism parts 58, to adjust the angle of the bundle 2 relative to the casing 3, while viewing the above relative angle display unit. Here, when the relative angles are adjusted, the angle of the bundle 2 can be changed in the horizontal direction and the vertical direction by using the intermediate travel devices 32 as supporting points.

Figure 7:
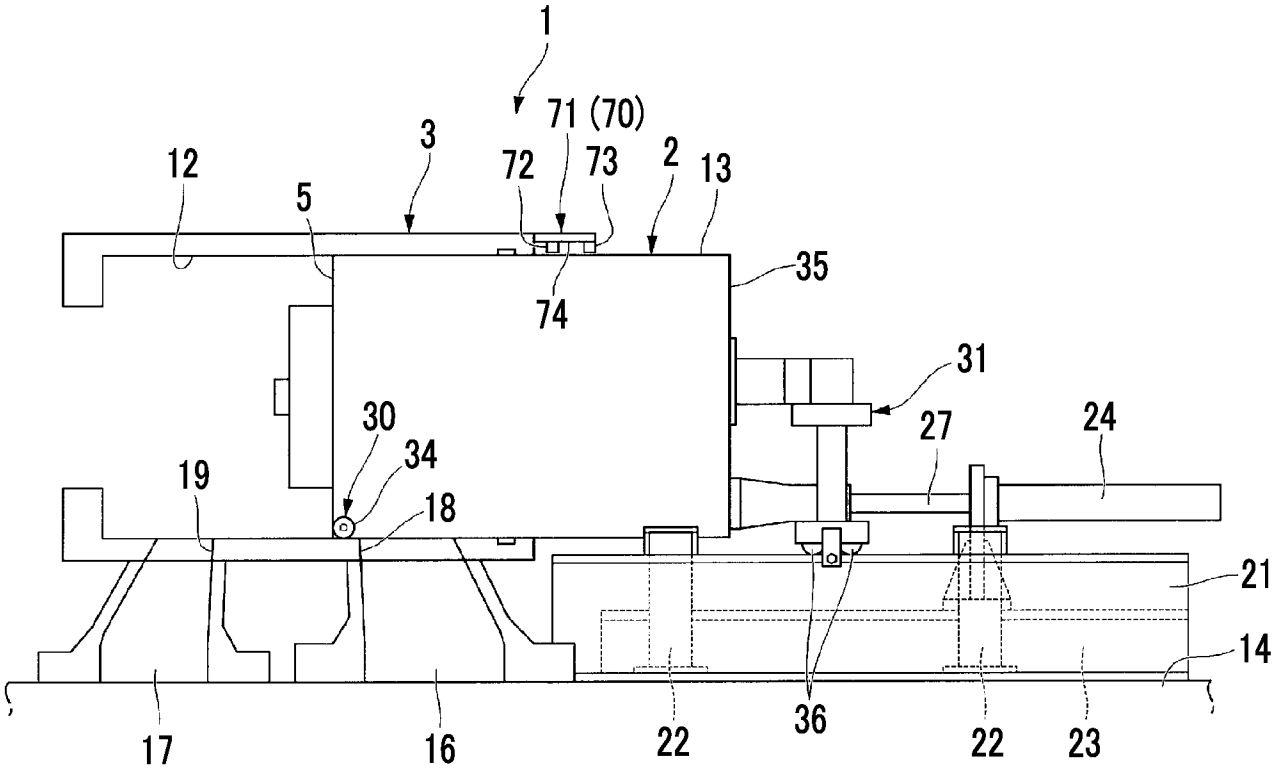
FIG. 7 is a side view equivalent to FIG. 1 illustrating a state during the insertion step in the first embodiment of the invention.

Thereafter, an insertion step of completely housing the bundle 2 in the casing 3 is performed (Step S05). More specifically, in the insertion step, as illustrated in FIG. 7, the intermediate travel devices 32 are detached from the bundle 2 in the middle of insertion. In this case, the height dimensions of the intermediate jack parts are reduced, and the bolts that fix the attachment bracket parts 55 of the intermediate leg members 54 are loosened to separate the attachment bracket parts 55 from the outer peripheral surface 13 of the bundle 2. Accordingly, the load of the bundle 2 is applied to the internal rollers 34, and the internal rollers 34 become rollable on the inner peripheral surface 12 of the casing 3. That is, a state where the bundle 2 is supported in a travelable manner by the internal travel devices 30 and the rear travel devices 31.

Figure 8:
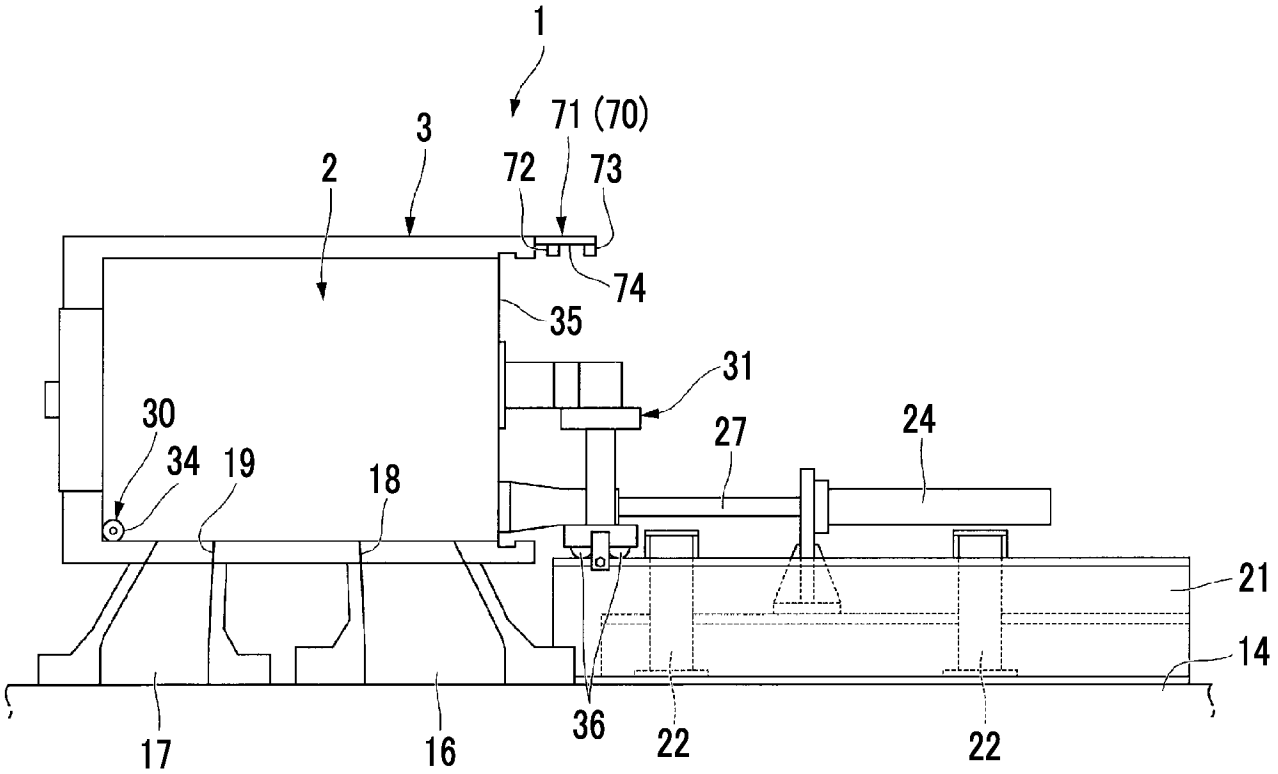
FIG. 8 is a side view equivalent to FIG. 1 illustrating a state where insertion of the bundle into a casing in the first embodiment of the invention is completed.

Next, the arrangement of the cylinder 24 is shifted to the casing 3 side. Thereafter, the rear end portion 35 of the bundle 2 is pressed by the cylinder 24. Then, the internal rollers 34 and the rear rollers 36 are rolled, and the bundle 2 is further inserted into the casing 3. As illustrated in FIG. 8, a series of steps are ended by stopping the pressing of the bundle 2 by the cylinder 24 when the bundle 2 is completely housed inside the casing 3. Here, after the pressing of the bundle 2 by the cylinder is stopped, the rail members 21, the cradles 22, and the cylinder rail 23 may be removed. Since the above respective steps may be performed in reverse order when the bundle 2 is pulled from the casing 3, the detailed description of a procedure in which the bundle 2 is pulled out from the casing 3 will be omitted.

Therefore, according to the assembly method for the compressor 1 of the above-described first embodiment, the height position of the bundle 2 can be adjusted on the basis of the relative positions in the vertical direction of the outer peripheral surface 13 of the bundle 2 and the inner peripheral surface 12 of the casing 3 that are measured at the opening 15 of the bundle 2. Therefore, the worker can precisely determine the possibility of contact between the bundle 2 and the casing 3. As a result, the contact between the outer peripheral surface 13 of the bundle 2 and the inner peripheral surface 12 of the casing 3 can be more reliably prevented.

Moreover, since the bundle 2 is supported in a travelable manner by the internal travel devices 30 and the rear travel devices 31, the bundle 2 can be inserted into the casing 3 in a state where the height position of the bundle after adjustment is maintained easily.

Additionally, when the relative positions in the vertical direction of the outer peripheral surface 13 of the bundle 2 and the inner peripheral surface 12 of the casing 3 vary while the bundle 2 is inserted into the casing 3, for example, the outer peripheral surface 13 of the bundle 2 and the inner peripheral surface 12 of the casing 3 are likely to come into contact with each other in the vertical direction, the height position of the bundle 2 can be adjusted again to avoid contact between the outer peripheral surface 13 of the bundle 2 and the inner peripheral surface 12 of the casing 3.

As a result, the bundle 2 can be easily inserted into the casing 3, while preventing contact between the casing 3 and the bundle 2 without requiring a worker's skill. Additionally, the working hours spent when the bundle 2 is inserted into the casing 3 can be shortened.

Additionally, the height of the bundle 2 can be easily adjusted simply by operating the rear jack parts 40 and the intermediate jack parts 56 for height adjustment. Therefore, working hours can be further shortened.

Moreover, the position of the bundle 2 in the horizontal direction can be adjusted such that the outer peripheral surface 13 of the bundle 2 and the inner peripheral surface 12 of the casing 3 do not come into contact with each other, on the basis of the relative positions in the horizontal direction of the outer peripheral surface 13 of the bundle 2 and the inner peripheral surface 12 of the casing 3.

Additionally, the relative angle of the bundle 2 with respect to the casing 3 can be adjusted such that the bundle 2 does not come into contact with the casing 3, on the basis of the relative angles of the inner peripheral surface 12 of the casing 3 and the outer peripheral surface 13 of the bundle 2. Therefore, the contact between the casing 3 and the bundle 2 can be prevented more reliably.

Next, a bundle guiding device in a second embodiment of the invention will be described. In addition, the bundle guiding device of this second embodiment is a device in which the operation manually performed by the worker in the above-described first embodiment is automated. Therefore, the same portions as those in the first embodiment will be designated by the same reference numerals, and duplicate description will be omitted.

Figure 12:
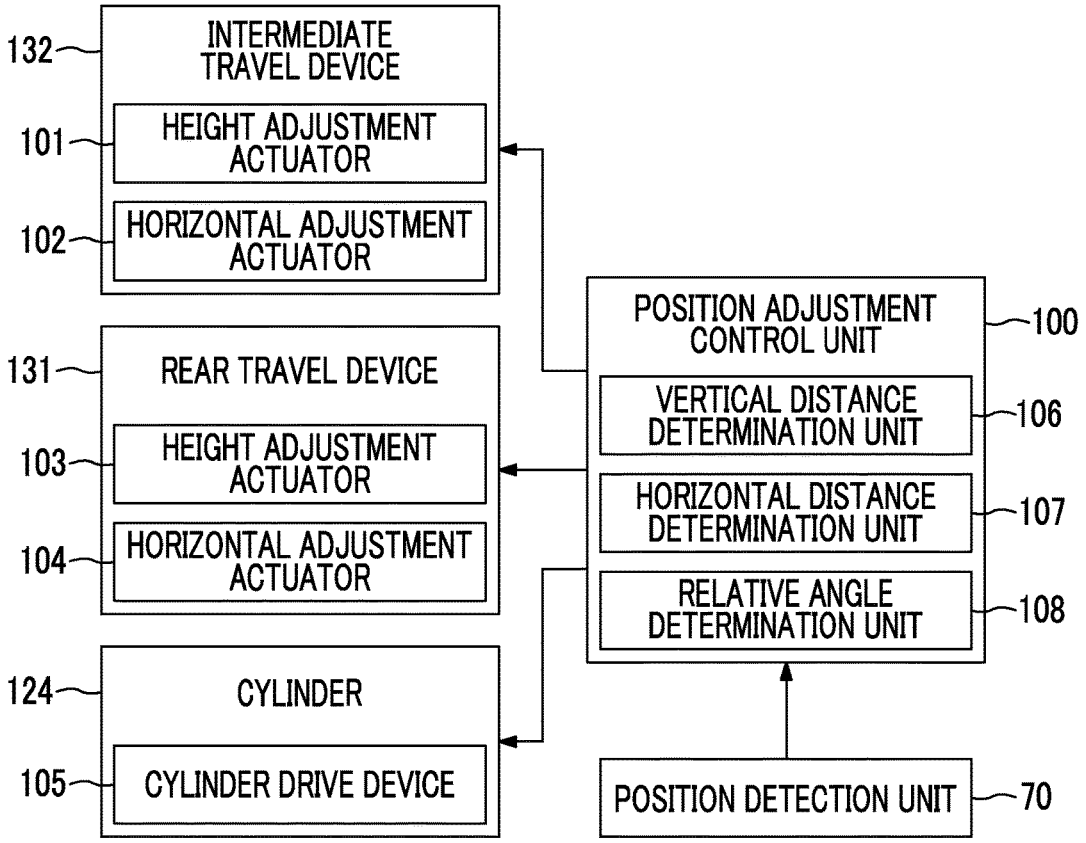
FIG. 12 is a block diagram illustrating a schematic configuration of the bundle guiding device in a second embodiment of the invention.

As illustrated in FIG. 12, the bundle guiding device in this second embodiment includes an intermediate travel device 132, a rear travel device 131, a cylinder 124, a position adjustment control unit 100, and the position detection unit 70. Since the position detection unit 70 is different from that of the above first embodiment only in terms of the output destination of measurement results, the detailed description thereof will be omitted.

The rear travel device 131 includes a height adjustment actuator 103 and a horizontal adjustment actuator 104, in addition to the configuration of the rear travel device 31 of the above-described first embodiment.

The height adjustment actuator 103 drives and operates the rear jack part 40 on the basis of a control command regarding a height position input from the position adjustment control unit 100. More specifically, the fluid pressure of the rear jack part 40 is adjusted.

The horizontal adjustment actuator 104 drives and operates the rear horizontal adjustment mechanism part 42 on the basis of a control command regarding a horizontal position from the position adjustment control unit 100. More specifically, the degree of being screwed of the position adjusting bolt 48 is adjusted.

The intermediate travel device 132 further includes a height adjustment actuator 101 and a horizontal adjustment actuator 102, in addition to the configuration of the intermediate travel device 32 of the above-described first embodiment.

The height adjustment actuator 101 drives and operates the intermediate jack part 56 on the basis of a control command regarding a height position input from the position adjustment control unit 100. More specifically, the fluid pressure of the intermediate jack part 56 is adjusted.

The horizontal adjustment actuator 102 drives and operates the intermediate horizontal adjustment mechanism part 58 on the basis of a control command regarding a horizontal position from the position adjustment control unit. More specifically, the degree of being screwed of the position adjusting bolt 66 is adjusted.

The cylinder 124 includes a cylinder drive device 105 consisting of a servo motor or the like, in addition to the configuration of the cylinder 24 of the above-described first embodiment. The cylinder drive device 105 drives and operates the cylinder 124 on the basis of a control command regarding the movement, in the direction of insertion, of the bundle 2 input from the position adjustment control unit 100. More specifically, cylinder pressure is adjusted in order to adjust the protruding amount of the inner rod 27.

The position adjustment control unit 100 performs the control of controlling the driving of the height adjustment actuators 101 and 103 and the horizontal adjustment actuators 102 and 104 of the intermediate travel device 132 and the rear travel device 131 on the basis of measurement results input from the position detection unit 70, and automatically adjusting the height position and the horizontal position of the bundle 2 and the relative angle of the bundle with respect to the casing 3. The position adjustment control unit 100 includes vertical distance determination means 106, horizontal distance determination means 107, and relative angle determination means 108.

The vertical distance determination means 106 obtains the distance in the vertical direction between the inner peripheral surface 12 of the casing 3 and the outer peripheral surface 13 of the bundle 2 on the basis of the measurement result of the position detection unit 70, and determines whether or not the distance in the vertical direction falls below a preset threshold. The position adjustment control unit 100 performs adjusting the height of the bundle 2 with the height adjustment actuators 101 and 103, thereby increasing the distance in the vertical direction, for example, when the vertical distance determination means 106 determines that the distance in the vertical direction falls below the preset threshold.

The horizontal distance determination means 107 obtains the distance in the horizontal direction between the inner peripheral surface 12 of the casing 3 and the outer peripheral surface 13 of the bundle 2 on the basis of the measurement result of the position detection unit 70, and determines whether or not the distance in the horizontal direction falls below a preset threshold. The position adjustment control unit 100 performs the control of moving the bundle 2 in the horizontal direction, using the horizontal adjustment actuators 102 and 104, such that the distance in the horizontal direction increases, for example, when the horizontal distance determination means 107 determines that the distance in the horizontal direction falls below the preset threshold.

The relative angle determination means 108 obtains the relative angles of the casing 3 and the bundle 2, on the basis of the measurement results of the position detection unit 70, and determines whether or not the relative angles exceed the preset threshold. The position adjustment control unit 100 performs the control of changing the angle of the bundle 2 with respect to the casing 3, using the relative angle determination means 108, such that the relative angles decrease, for example, when the relative angle determination means 108 determines that the relative angles exceed the preset threshold.

Therefore, according to the bundle guiding device of the above-described second embodiment, the position adjustment control unit 100 can automatically perform the position adjustment of the bundle 2 using the rear jack part 40, the intermediate jack part 56, the rear horizontal adjustment mechanism part 42, and the intermediate horizontal adjustment mechanism part 58, which are position adjustment mechanisms, on the basis of the relative positions of the outer peripheral surface 13 of the bundle 2 and the inner peripheral surface 12 of the casing 3 at the opening 15 of the casing 3 detected by the position detection unit 70. Therefore, variations of a bundle position due to a worker's level of skill can be suppressed compared to a case where the rear jack part 40, the intermediate jack part 56, and the rear horizontal adjustment mechanism part 42, and the intermediate horizontal adjustment mechanism part 58 are operated to adjust the position of the bundle 2 after the worker views the detection result of the position detection unit 70. Moreover, since position adjustment using the rear jack part 40, the intermediate jack part 56, the rear horizontal adjustment mechanism part 42, and the intermediate horizontal adjustment mechanism part 58 can be performed substantially simultaneously, the bundle 2 can be rapidly inserted into the casing 3, while preventing contact between the bundle 2 and the casing 3.

Additionally, when the distance between the outer peripheral surface 13 of the bundle 2 and the inner peripheral surface 12 of the casing 3, which is detected at the opening 15, falls below a threshold, the movement of the bundle 2 in the direction of insertion can be stopped to prevent the bundle 2 and the casing 3 from coming into contact with each other. Additionally, since the position adjustment of the bundle 2 can be performed to increase the distance between the outer peripheral surface 13 of the bundle 2 and the inner peripheral surface 12 of the casing 3, the contact between the outer peripheral surface 13 of the bundle 2 and the inner peripheral surface 12 of the casing 3 can be prevented when the movement of the bundle 2 in the direction of insertion is resumed.

In addition, the invention is not limited to the above-described respective embodiments, and various changes can be made to the above-described embodiments without departing from the scope of the invention. That is, the specific shapes, configurations, or the like mentioned in the embodiments are merely examples, and can be changed appropriately.

For example, in the above-described respective embodiments, a case where three distance sensors 71 are at regular intervals in the circumferential direction of the casing 3, the number of distance sensors 71 to be installed is not limited to three. For example, a total of four distance sensors 71 may be provided on both upper and lower sides in the vertical direction of the axis O2 of the opening 15 and on both left and right sides in the horizontal direction of the axis O2. By adopting such a configuration, the number of distance sensors 71 to be installed increases. However, the distance in the vertical direction and the distance in the horizontal direction between the outer peripheral surface 13 of the bundle 2 and the inner peripheral surface 12 of the casing can be directly and easily obtained from measurement results of the respective distance sensors 71.

Moreover, a case including the respective steps of measuring the distance in the vertical direction, the distance in the horizontal direction, and the relative angles of the outer peripheral surface 13 of the bundle 2 and the inner peripheral surface 12 of the casing 3 at the opening 15, respectively, to adjust the height position, the horizontal position, and the relative angle of the bundle 2 with respect to the casing 3 has been described. However, the horizontal position adjustment step and the relative angle adjustment step of the bundle 2 may be appropriately performed or omitted if necessary. Additionally, when the relative angles are not detected, the rear sensors 73 may be omitted.

Moreover, although cases where the intermediate travel devices 32 and 132 are provided have been described in the above-described respective embodiments, the intermediate travel devices 32 may be omitted when the bundle 2 is small-sized or when the length dimension of the bundle in the direction of the axis O1 is short.

Moreover, although a case where the distance on the upper side in the vertical direction between the outer peripheral surface 13 of the bundle 2 and the inner peripheral surface 12 of the casing 3 is obtained by the position detection unit 70 disposed vertically above the axis O2 has been described in the above-described respective embodiments, the distance on the lower side in the vertical direction may be obtained using other two position detection units 70.

INDUSTRIAL APPLICABILITY

The invention relates to the compressor assembly method and the bundle guiding device. According to the invention, the bundle can be easily inserted into the casing, while preventing contact between the casing and the bundle without requiring a worker's skill. Moreover, the working hours spent when the bundle is inserted into the casing can be shortened.

REFERENCE SIGNS LIST

1: COMPRESSOR
2: BUNDLE
3: CASING
4: ROTOR
5: FRONT END PORTION
6: POSITIONING CONVEX PORTION
7: BODY PORTION
8: OUTER PERIPHERAL WALL
9: FRONT END PORTION
10: BOTTOM WALL
11: HOLE PORTION
12: INNER PERIPHERAL SURFACE
13: OUTER PERIPHERAL SURFACE
14: PLATFORM
15: OPENING
16: SUCTION NOZZLE
17: DISCHARGE NOZZLE
18: THROUGH-HOLE
19: THROUGH-HOLE
21: RAIL MEMBER
22: CRADLE
23: CYLINDER RAIL
24, 124: CYLINDER
25: UPPER SURFACE
26: INCLINED SURFACE
27: INNER ROD
30: INNER TRAVEL DEVICE
31,131: REAR TRAVEL DEVICE
32,132: INTERMEDIATE TRAVEL DEVICE
34: INNER ROLLER
35: REAR END PORTION
36: REAR ROLLER
37: REAR LEG MEMBER
38: REAR EXTENDING PORTION
39: HORIZONTAL EXTENDING PART
40: REAR JACK PART
41: REAR ROLLER SUPPORT PART
42: REAR HORIZONTAL ADJUSTMENT MECHANISM PART
43: FRONT END PORTION
44: FLANGE PART
45: OUTER END PORTION
47: ARM MEMBER
48: POSITION ADJUSTING BOLT
49: OUTER SURFACE
50: SCREW HOLE
52: INTERMEDIATE PORTION
53: INTERMEDIATE ROLLER
54: INTERMEDIATE-LEG MEMBER
55: ATTACHMENT BRACKET PART
56: INTERMEDIATE JACK PART
57: INTERMEDIATE ROLLER SUPPORT PART
58: INTERMEDIATE HORIZONTAL ADJUSTMENT MECHANISM PART
59: FASTENING PART
60: OVERHANGING PART
61: ATTACHMENT SEAT PORTION
62: OUTER SURFACE
63: ARM MEMBER
64: OUTER SURFACE
65: SCREW HOLE
66: POSITION ADJUSTING BOLT
70: POSITION DETECTION UNIT
71: DISTANCE SENSOR
72: FRONT SENSOR
73: REAR SENSOR
74: BRACKET
75: PERIPHERAL EDGE
76: DISPLAY CONTROL UNIT
77: VERTICAL DISTANCE CALCULATION UNIT
78: HORIZONTAL DISTANCE CALCULATION UNIT
79: RELATIVE ANGLE CALCULATION UNIT
80: VERTICAL DISTANCE DISPLAY UNIT
81: HORIZONTAL DISTANCE DISPLAY UNIT
82: RELATIVE ANGLE DISPLAY UNIT
100: POSITION ADJUSTMENT CONTROL UNIT
101: HEIGHT ADJUSTMENT ACTUATOR
102: HORIZONTAL ADJUSTMENT ACTUATOR
103: HEIGHT ADJUSTMENT ACTUATOR
104: HORIZONTAL ADJUSTMENT ACTUATOR

105: CYLINDER DRIVE DEVICE
106: VERTICAL DISTANCE DETERMINATION MEANS
107: HORIZONTAL DISTANCE DETERMINATION MEANS
108: RELATIVE ANGLE DETERMINATION MEANS
O1: AXIS
O2: AXIS

The invention claimed is:

1. An assembly method for a compressor comprising:
a bundle having a rotor; and
a casing into which the bundle is inserted, using a guiding device including:
an internal travel device capable of supporting a front end portion of the bundle in a direction of insertion of the bundle and capable of traveling on an inner peripheral surface of the casing; and
an external travel device including a rear travel device and an intermediate travel device, the rear travel device being capable of supporting a rear end portion of the bundle in the direction of insertion of the bundle and capable of traveling on a base surface extending from an opening of the casing toward the rear in the direction of insertion of the bundle, and the intermediate travel device being capable of supporting the bundle between the front end portion and the rear end portion and capable of traveling on the base surface,
wherein the rear travel device includes:
a rear jack part capable of adjusting a vertical position of the bundle in a vertical direction which is perpendicular to the direction of insertion of the bundle, and
a rear horizontal adjustment mechanism part capable of adjusting a horizontal position of the bundle in a horizontal direction which is perpendicular to the direction of insertion of the bundle, and
wherein the intermediate travel device includes:
an intermediate jack part capable of adjusting a vertical position of the bundle in a vertical direction which is perpendicular to the direction of insertion of the bundle, and
an intermediate horizontal adjustment mechanism part capable of adjusting a horizontal position of the bundle in a horizontal direction which is perpendicular to the direction of insertion of the bundle,
wherein, the assembly method comprising:
an arrangement step of arranging the bundle such that the external travel device is capable of traveling on the base surface and the internal travel device is capable of traveling on the inner peripheral surface of the casing, and arranging the bundle such that an axis of the bundle in the horizontal direction is coincident with an axis of the casing in the horizontal direction using the rear horizontal adjustment mechanism part and the intermediate horizontal adjustment mechanism part;
a vertical position adjustment step of, while measuring relative positions in the vertical direction of the inner peripheral surface of the casing and an outer peripheral surface of the bundle at the opening of the casing, adjusting a height position of the bundle supported by the external travel device on the basis of the measured relative positions in the vertical direction; and
an insertion step of inserting the bundle into the casing while the vertical position adjustment step is performed.

2. The compressor assembly method according to claim 1, wherein, in the vertical position adjustment step, the height of the bundle is adjusted using the rear jack part provided between the rear travel device and the bundle.

3. The compressor assembly method according to claim 1, further comprising:
a horizontal position adjustment step of, while measuring relative positions in the horizontal direction of the inner peripheral surface of the casing and the outer peripheral surface of the bundle at the opening of the casing, adjusting the horizontal position of the bundle supported by the external travel device on the basis of measured relative positions in the horizontal direction.

4. The compressor assembly method according to claim 1, further comprising:
a relative angle adjustment step of, while measuring relative angles of the casing and the bundle, adjusting the relative angle of the bundle supported by the external travel device on the basis of the measured relative angles.

5. The compressor assembly method according to claim 2, further comprising:
a relative angle adjustment step of, while measuring relative angles of the casing and the bundle, adjusting the relative angle of the bundle supported by the external travel device on the basis of the measured relative angles.

6. The compressor assembly method according to claim 3, further comprising:
a relative angle adjustment step of, while measuring relative angles of the casing and the bundle, adjusting the relative angle of the bundle supported by the external travel device on the basis of the measured relative angles.

7. A bundle guiding device for a compressor including a bundle having a rotor, and a casing into which the bundle is inserted, the bundle guiding device comprising:
an internal travel device provided in a front end portion of the bundle in a direction of insertion of the bundle and capable of traveling on an inner peripheral surface of the casing;
an external travel device including a rear travel device and an intermediate travel device, the rear travel device being provided in a rear end portion of the bundle in the direction of insertion of the bundle and capable of traveling on a base surface extending from an opening of the casing toward the rear in the direction of insertion, and the intermediate travel device being capable of supporting the bundle between the front end portion and the rear end portion and capable of traveling on the base surface;
a position detection unit configured to dispose at the opening of the casing to detect relative positions of the outer peripheral surface of the bundle and the inner peripheral surface of the casing;
a position adjustment mechanism configured to adjust a position of the bundle supported by the external travel device; and
a position adjustment control unit configured to control position adjustment using the position adjustment mechanism on the basis of the position detected by the position detection unit,
wherein the rear travel device includes:
a rear jack part capable of adjusting a vertical position of the bundle in a vertical direction which is perpendicular to the direction of insertion of the bundle, and
a rear horizontal adjustment mechanism part capable of adjusting a horizontal position of the bundle in a horizontal direction which is perpendicular to the direction of insertion of the bundle, and wherein the intermediate travel device includes:

an intermediate jack part capable of adjusting a vertical position of the bundle in a vertical direction which is perpendicular to the direction of insertion of the bundle, and an intermediate horizontal adjustment mechanism part capable of adjusting a horizontal position of the bundle in a horizontal direction which is perpendicular to the direction of insertion of the bundle.

8. The bundle guiding device for a compressor according to claim 7, further comprising:

a moving mechanism that moves the bundle in a direction in which the bundle is inserted into the casing, wherein the position adjustment control unit determines whether or not a distance between the outer peripheral surface of the bundle and the inner peripheral surface of the casing falls below a preset threshold, on the basis of the detection performed by the position detection unit, and when it is determined that the distance falls below the threshold, the position adjustment control unit allows the moving mechanism to stop the movement of the bundle in the direction of insertion and allows the position adjustment mechanism to perform the position adjustment of the bundle in a direction which the distance between the outer peripheral surface of the bundle and the inner peripheral surface of the casing increases.

9. The compressor assembly method according to claim 2, further comprising:

a horizontal position adjustment step of, while measuring relative positions in a horizontal direction of the inner peripheral surface of the casing and the outer peripheral surface of the bundle at the opening of the casing, adjusting a horizontal position of the bundle supported by the external travel device on the basis of measured relative positions in the horizontal direction.

* * * * *